US012029294B1

(12) United States Patent
Zeng

(10) Patent No.: US 12,029,294 B1
(45) Date of Patent: Jul. 9, 2024

(54) CARD HOLDER

(71) Applicant: Shenzhen Wanhui Technology Innovation Co., Ltd., Shenzhen (CN)

(72) Inventor: Zheng Zeng, Shenzhen (CN)

( * ) Notice: Subject to any disclaimer, the term of this patent is extended or adjusted under 35 U.S.C. 154(b) by 0 days.

(21) Appl. No.: 18/343,216

(22) Filed: Jun. 28, 2023

(30) Foreign Application Priority Data

Jun. 13, 2023 (CN) ..... 202321505418.9

(51) Int. Cl.
*A45C 11/18* (2006.01)

(52) U.S. Cl.
CPC ..... *A45C 11/182* (2013.01)

(58) Field of Classification Search
CPC ..... A45C 11/182; A45C 11/00
See application file for complete search history.

(56) References Cited

U.S. PATENT DOCUMENTS 2,784,757 A * 3/1957 Bosca ..... A45C 13/1069 206/581
3,749,301 A * 7/1973 Peckar ..... B65D 5/6673 229/125.37
4,792,058 A * 12/1988 Parker ..... B65D 83/12 221/232
4,852,727 A * 8/1989 Oberle ..... B42F 17/30 206/556
5,125,505 A * 6/1992 Kurosaki ..... G09F 3/18 206/556
D447,337 S * 9/2001 Sardina ..... D3/247
8,944,833 B2 * 2/2015 Takahashi ..... H05K 5/0295 439/159
D950,954 S * 5/2022 Tran ..... D3/247
2009/0101255 A1 * 4/2009 Long ..... A45C 11/182 150/147
2014/0043741 A1 * 2/2014 Smith ..... H04M 1/0206 206/472
2018/0310681 A1 * 11/2018 Wingerter ..... B42F 17/32
2018/0338593 A1 * 11/2018 Scharnigg ..... B65D 83/08
2019/0013833 A1 * 1/2019 Horn ..... H04B 1/3888
2019/0387853 A1 * 12/2019 Chan ..... A45C 11/18
2020/0315308 A1 * 10/2020 Van Geer ..... B65D 83/08
2022/0079316 A1 * 3/2022 Goodwin ..... A45C 13/185

* cited by examiner

*Primary Examiner* — Don M Anderson
*Assistant Examiner* — Justin Caudill

(57) ABSTRACT

The present disclosure discloses a card holder, which includes a shell and an elastic piece. The shell having a first accommodating cavity and a first accommodating opening, the first accommodating opening being communicated with the first accommodating cavity, and first accommodating cavity being used for accommodating a card. The elastic piece being arranged in the first accommodating cavity, and the elastic piece being used for pressing and locking the card in the first accommodating cavity. Through the structure, when the card is placed in the first accommodating cavity through the first accommodating opening. The elastic piece arranged in the first accommodating cavity is pressed by both sides of the card. An elastic reset force generated when the elastic piece is pressed tightly presses the card in the first accommodating cavity, which can effectively prevent the card from sliding out of the first accommodating cavity through the first accommodating opening.

7 Claims, 10 Drawing Sheets

CARD HOLDER

CROSS-REFERENCE TO RELATED APPLICATIONS

The application claims priority of Chinese patent application CN2023215054189, filed on 2023 Jun. 13, which is incorporated herein by reference in its entireties.

TECHNICAL FIELD

The present disclosure relates to the field of card holders, and in particular, to a card holder.

BACKGROUND

In modern life, people have to deal with cards to a certain degree, such as various Integrated Circuit (IC) cards, bank cards, supermarkets cards, shopping cards, and membership cards. So many cards are difficult to store and prone to confusion, which often bring many unnecessary troubles. Card holders have emerged to manage such a large number of cards, which may be considered as a product of modern economy. A traditional card holder on the market is usually provided with an accommodating cavity and an accommodating opening, cards are placed in the accommodating cavity through the accommodating opening, and the accommodating opening is covered with a lid. However, there are the following problems: the cards are prone to shaking in the accommodating cavity. When the lid is open, or the lid is open by mistake inadvertently, or it is forgotten to cover the accommodating opening with the lid, the cards are prone to sliding out of the accommodating cavity through the accommodating opening, resulting in the loss of the cards and irreparable losses to users.

SUMMARY

In order to overcome the shortcomings of the prior art, the present disclosure provides a card holder, including:

a shell, the shell having a first accommodating cavity and a first accommodating opening, the first accommodating opening being communicated with the first accommodating cavity, and the first accommodating cavity being used for accommodating a card; and an elastic piece, the elastic piece being arranged in the first accommodating cavity, and the elastic piece being used for pressing and locking the card in the first accommodating cavity.

As the improvement of the present disclosure, the elastic piece is a silicone elastic piece.

As the improvement of the present disclosure, the card holder further including a pushing device, the pushing device being connected to the shell, and the pushing device being used for pushing the card out of the first accommodating cavity via the first accommodating opening.

As the improvement of the present disclosure, the shell further includes a first side wall opposite to the first accommodating opening, and a second side wall, a third side wall opposite to the second side wall, and a fourth side wall, and a fifth side wall opposite to the fourth side wall; the first accommodating cavity is formed by enclosure of the first side wall, the second side wall, the third side wall, the fourth side wall, and the fifth side wall; the elastic piece is arranged on an inner surface of the second side wall; and the elastic piece is used for pressing and locking the card on the third side wall.

As the improvement of the present disclosure, the pushing device includes a pushing button, a pushing rod, and a pushing plate; a sliding rail is arranged on the shell; the pushing button is capable of sliding on the sliding rail; the pushing rod is connected to the pushing button, so that the pushing rod is capable of sliding with the pushing button; the pushing plate has a first end and a second end; a mounting port is between the first end and the second end; a rotating shaft is arranged at a bottom of an inner wall of the first accommodating cavity; the rotating shaft is arranged in the mounting port of the pushing plate in a sleeving manner; and when the pushing button and the pushing rod push the first end to a direction deviating from the first accommodating opening, the second end is pushed to a direction towards the first accommodating opening to push the card out of the first accommodating cavity towards the first accommodating opening.

As the improvement of the present disclosure, the pushing device further includes an elastic reset piece; one end of the elastic reset piece is connected to the first accommodating cavity; the other end of the elastic reset piece is connected to one end of the pushing rod; when the other ends of the pushing button and the pushing rod push the first end to a direction deviating from the first accommodating opening, the elastic reset piece is stretched; and an elastic reset force provided when the elastic reset piece is stretched is capable of pulling the pushing rod and the pushing button to reset to a direction towards the accommodating opening.

As the improvement of the present disclosure, a positioning piece is also arranged on the inner wall of the first accommodating cavity; a positioning opening is formed in the elastic piece; and the positioning piece is arranged in the positioning opening in a sleeving manner.

As the improvement of the present disclosure, a plurality of elastic bulges are formed on the elastic piece; and the card is pressed and locked in the first accommodating cavity by the elastic bulges.

As the improvement of the present disclosure, the card holder further including a flexible protective sleeve, wherein the flexible protective sleeve has a first part and a second part; the second part and the first part are capable of rotating relative to each other; the first part is connected to an outer surface of the fourth side wall; and when the second part rotates to cover an outer surface of the fifth side wall, the second part covers the first accommodating opening.

As the improvement of the present disclosure, the second part is provided with a magnetic attraction piece; the fifth side wall is a magnetic metal side wall; and when the second part rotates to cover the outer surface of the fifth side wall, the second part is attracted to the outer surface of the fifth side wall by the magnetic attraction piece.

As the improvement of the present disclosure, the card holder further including an elastic clip, wherein one end of the clip is connected to the shell, and the other end of the clip is tightly pressed to the first part to form clamping space between the clip and the first part.

As the improvement of the present disclosure, the shell also has a mounting groove. The card holder further includes a first connecting piece. A side wall of the mounting groove has a first mounting hole. A second mounting hole is formed in one end of the clip. When one end of the clip is inserted into the mounting groove, the first mounting hole is aligned with the second mounting hole. The first connecting piece penetrates through the first mounting hole and the second mounting hole in sequence, so as to fix one end of the clip to the interior of the mounting groove.

As the improvement of the present disclosure, the fifth side wall is detachably connected to the first side wall, the second side wall, and the third side wall.

As the improvement of the present disclosure, the first part includes a first plate body and a second plate body. The inner side of the first plate body covers the outer surface of the fourth side wall. The second plate body is connected to an outer side of the first plate body, and a second accommodating cavity is formed between an inner side of the second plate body and an outer wall of the first plate body. An upper side of the second accommodating cavity has a second accommodating opening, and a first gap is formed in a lower side of the second accommodating cavity.

As the improvement of the present disclosure, one end of the clip is connected to the shell, and the other end of the clip is tightly pressed to the first plate body, so that clamping space is formed between the clip and the first part.

As the improvement of the present disclosure, the pushing device further includes an elastic reset piece; one end of the elastic reset piece is connected to the first end; the other end of the elastic reset piece is connected to a bottom of the first accommodating cavity; when the pushing button and the pushing rod push the first end to the direction deviating from the first accommodating opening, the elastic reset piece is compressed; an elastic reset force provided when the elastic reset piece is compressed is capable of pushing the first end, the pushing rod, and the pushing button to reset towards the accommodating opening.

As the improvement of the present disclosure, the second part includes a third plate body, a fourth plate body, a fifth plate body, and a sixth plate body. The third plate body is rotatably connected to the first plate body. The fourth plate body is connected to the inner side of the third plate body. A third accommodating cavity is formed between the fourth plate body and the inner side of the third plate body. The upper side of the third accommodating cavity has a third accommodating opening. The lower side of the third accommodating cavity has a second gap. The fifth plate body is connected to the outer side of the third plate body. A fourth accommodating cavity is formed between the inner side of the fifth plate body and the outer side of the third plate body. The upper side of the fourth accommodating cavity has a fourth accommodating opening. The sixth plate body is connected to the outer side of the third plate body. A fifth accommodating cavity is formed between the inner side of the sixth plate body and the outer side of the fifth plate body. An upper side of the fifth accommodating cavity has a fifth accommodating opening. A lower side of the fifth accommodating cavity has a third gap. The third gap, the fifth accommodating cavity, and the fourth accommodating cavity are communicated with one another.

As the improvement of the present disclosure, the protective sleeve further includes a seventh plate body and an eighth plate body. The inner side of the seventh plate body is connected to the fourth side wall. The eighth plate body is connected to an outer side of the seventh plate body, and a sixth accommodating cavity is formed between the inner side of the eighth plate body and the outer side of the seventh plate body. A sixth accommodating opening is formed in an upper side of the sixth accommodating cavity. A transparent area is formed in the eighth plate body. A fourth gap is formed in the transparent area. The fourth gap is communicated with the sixth accommodating cavity.

As the improvement of the present disclosure, a hanging port is also formed in the shell.

As the improvement of the present disclosure, a plurality of steps are formed on the second end. The height of the plurality of steps gradually increases from the second end to the first end.

As the improvement of the present disclosure, the number of the plurality of steps is at least.

Beneficial effects: the present disclosure discloses a card holder includes a shell, the shell having a first accommodating cavity and a first accommodating opening, the first accommodating opening being communicated with the first accommodating cavity, and first accommodating cavity being used for accommodating a card; and an elastic piece, the elastic piece being arranged in the first accommodating cavity, and the elastic piece being used for pressing and locking the card in the first accommodating cavity. Through the structure, when the card is placed in the first accommodating cavity through the first accommodating opening. The elastic piece arranged in the first accommodating cavity is pressed by both sides of the card. An elastic reset force generated when the elastic piece is pressed tightly presses the card in the first accommodating cavity, which can effectively prevent the card from sliding out of the first accommodating cavity through the first accommodating opening, and prevent the card from loss. When a user needs to take out the card, the card may be taken out from the first accommodating opening only by applying a force greater than the elastic reset force generated when the elastic piece is pressed to the card.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
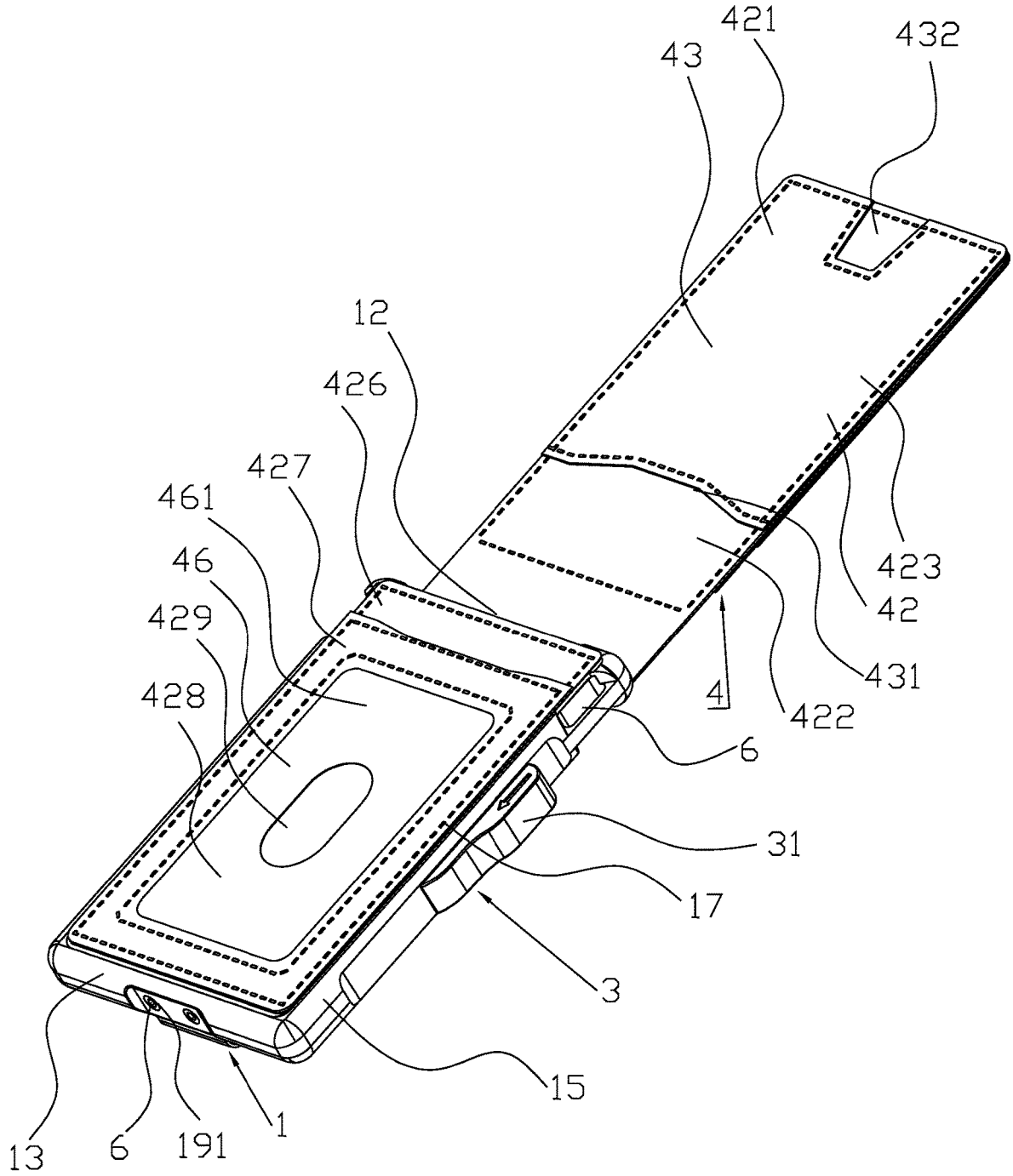
FIG. 1 is a schematic diagram of an overall structure of the present disclosure.
Figure 2:
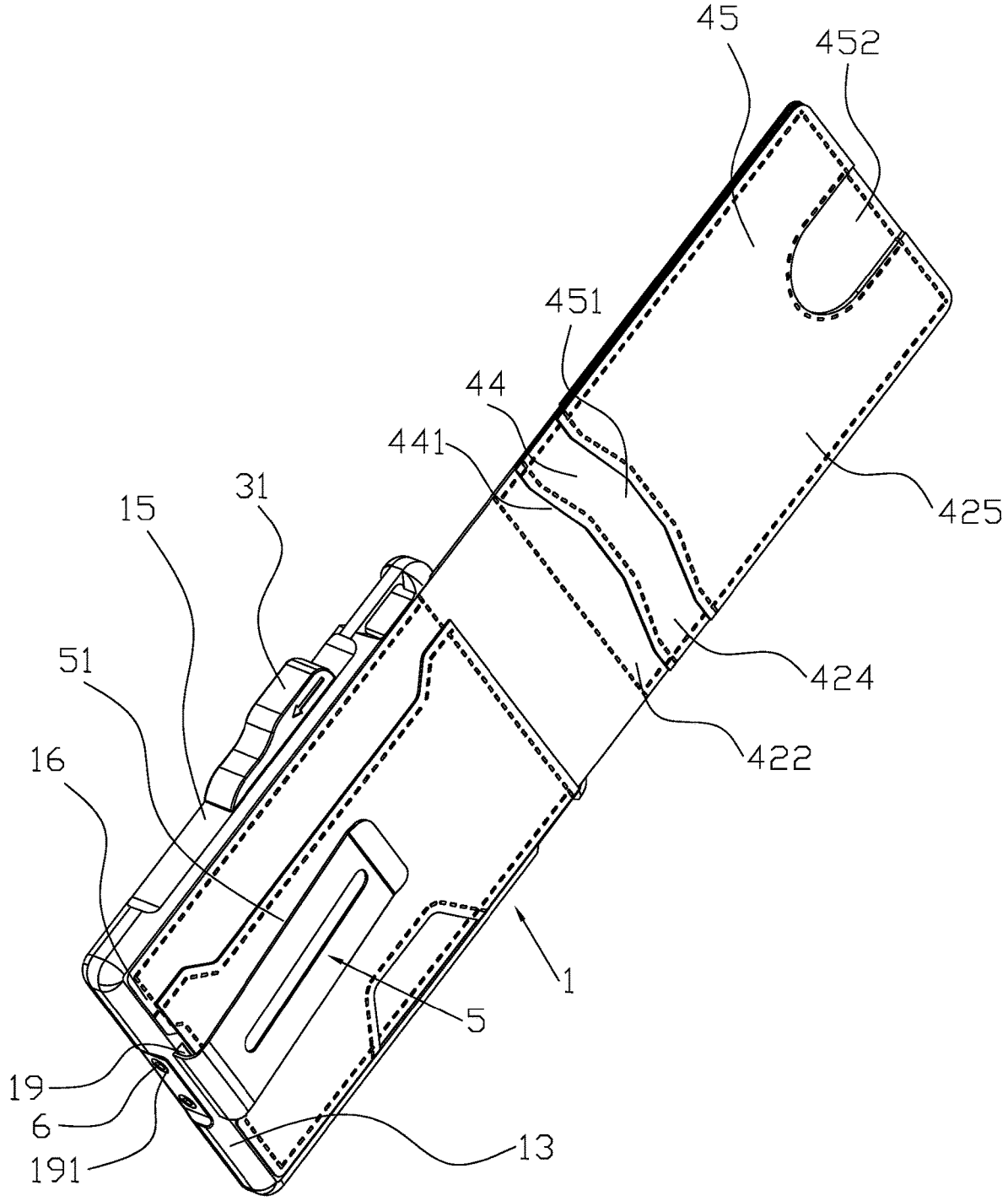
FIG. 2 is a schematic diagram of another overall structure of the present disclosure.
Figure 3:
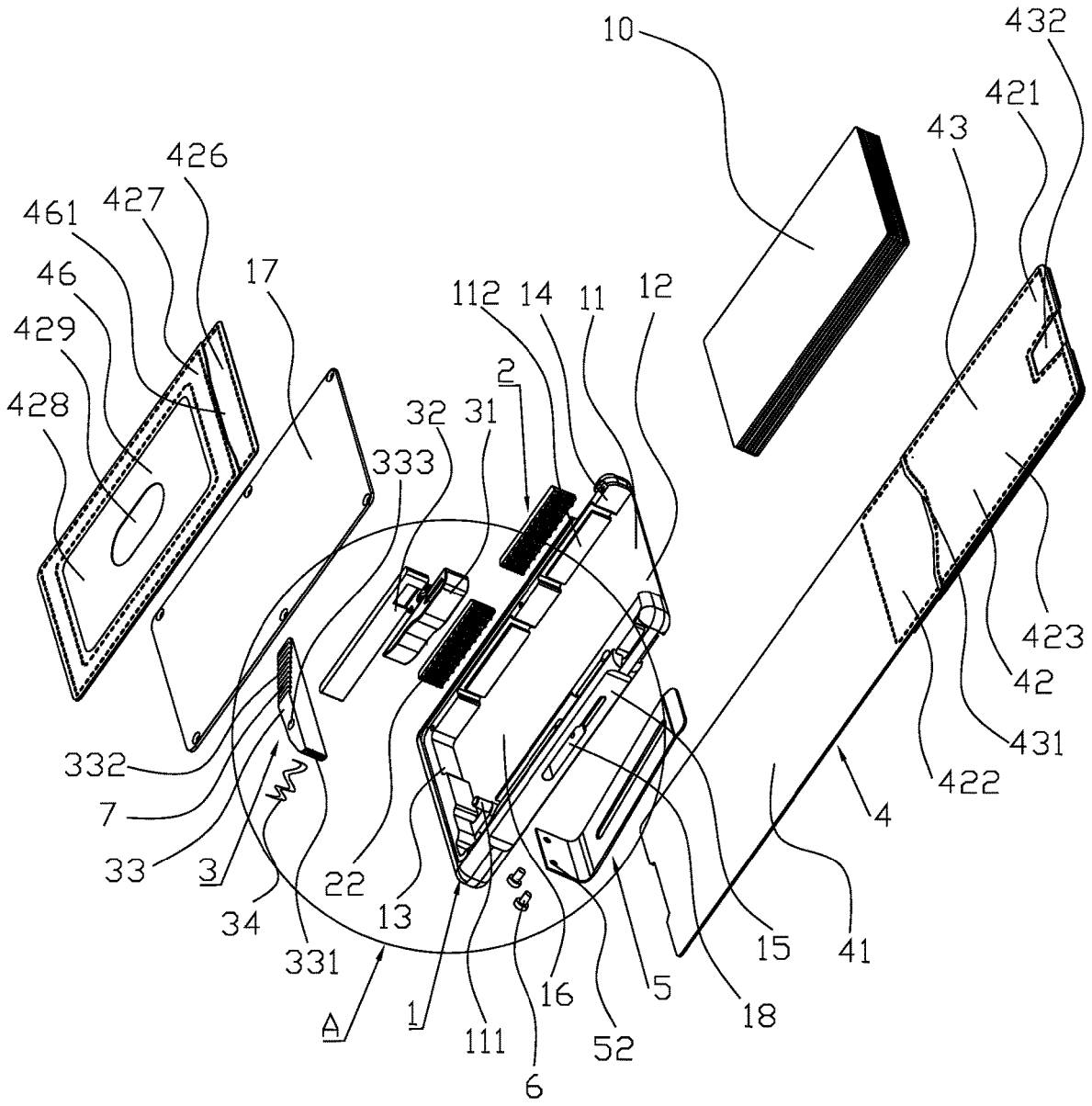
FIG. 3 is an exploded view of the present disclosure.
Figure 4:
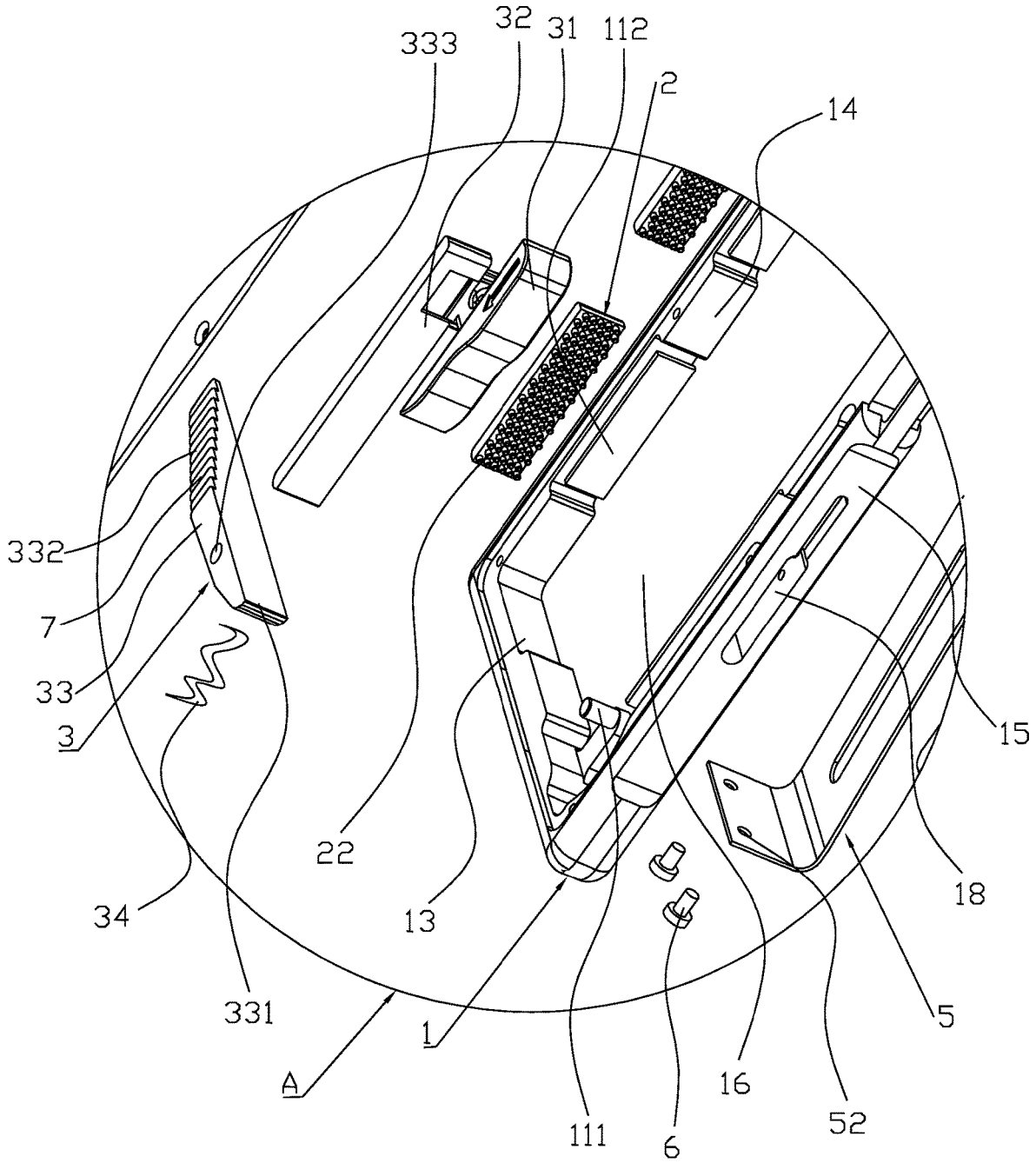
FIG. 4 is an enlarged view of A in FIG. 3.
Figure 5:
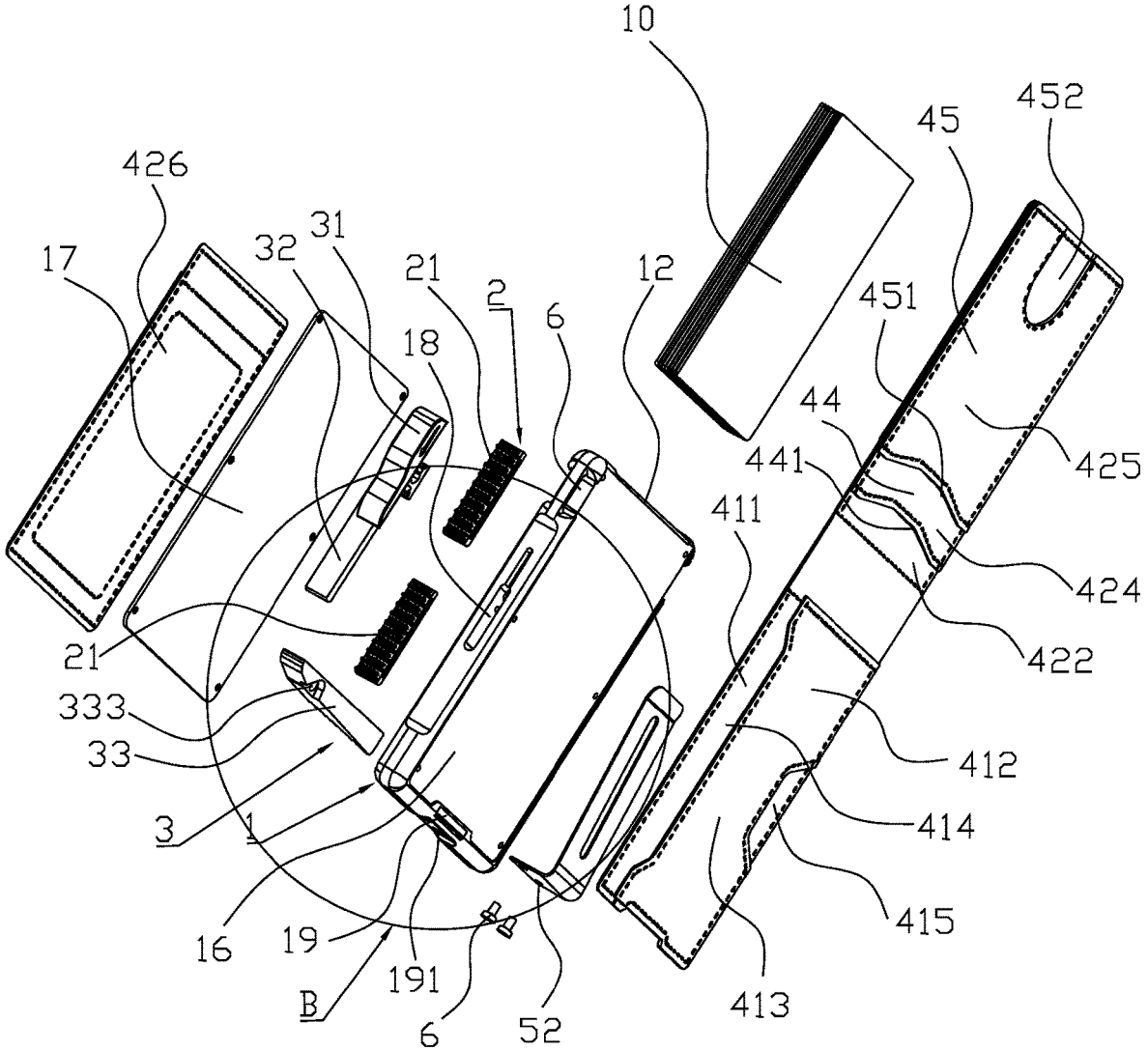
FIG. 5 is another exploded view of the present disclosure.
Figure 6:
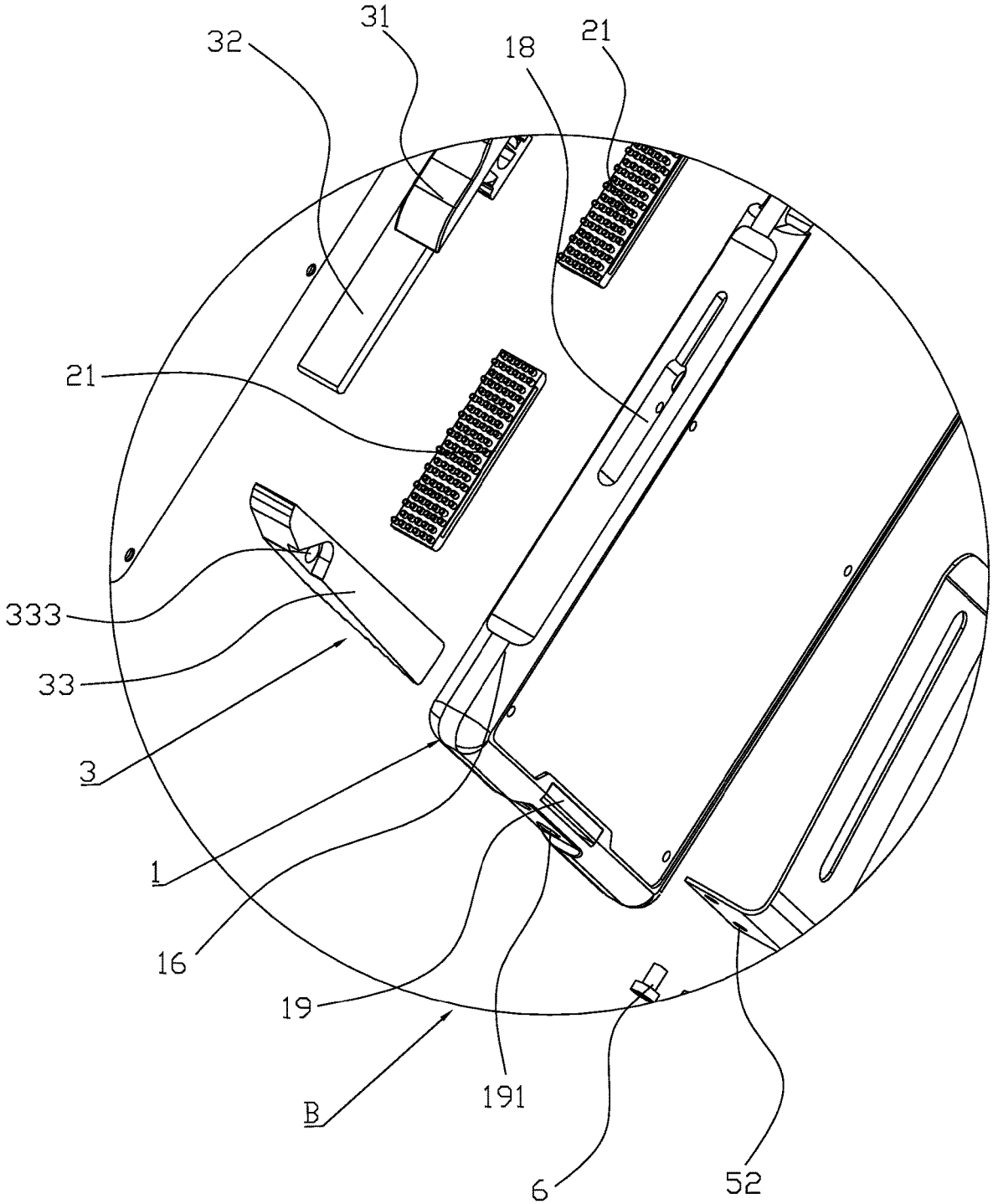
FIG. 6 is an enlarged view of B in FIG. 5.

Referring to FIG. 1 to FIG. 9, a card holder includes:

a shell 1, the shell 1 having a first accommodating cavity 11 and a first accommodating opening 12, the first accommodating opening 12 being communicated with the first accommodating cavity 11, and first accommodating cavity 11 being used for accommodating a card 10; and an elastic piece 2, the elastic piece 2 being arranged in the first accommodating cavity 11, and the elastic piece 2 being used for pressing and locking the card 10 in the first accommodating cavity 11.

Through the structure, when the card is placed in the first accommodating cavity through the first accommodating opening. The elastic piece arranged in the first accommodating cavity is pressed by both sides of the card. An elastic reset force generated when the elastic piece is pressed tightly presses the card in the first accommodating cavity, which can effectively prevent the card from sliding out of the first accommodating cavity through the first accommodating opening, and prevent the card from loss. When a user needs to take out the card, the card may be taken out from the first accommodating opening only by applying a force greater than the elastic reset force generated when the elastic piece is pressed to the card.

In the present embodiment, the elastic piece 2 is a silicone elastic piece. Specifically, a plurality of elastic bulges 22 are formed on the elastic piece 2; and the card is pressed and locked in the first accommodating cavity 11 by the elastic bulges 22. Further, a positioning piece 112 is also arranged on the inner wall of the first accommodating cavity 11; a positioning opening 21 is formed in the elastic piece 2; and the positioning piece 112 is arranged in the positioning opening 21 in a sleeving manner. Through the structure, the elastic piece is effectively mounted, the card may be pressed and locked in the first accommodating cavity through the elastic bulges on the silicone elastic piece, the elastic property of silicone is good, and elastic force may be maintained for a long time. Compared with an ordinary spring and elastic piece, the silicone elastic piece has longer service life and softer texture, and cannot damage the card when the card is tightly pressed in the first accommodating cavity.

Figure 10:
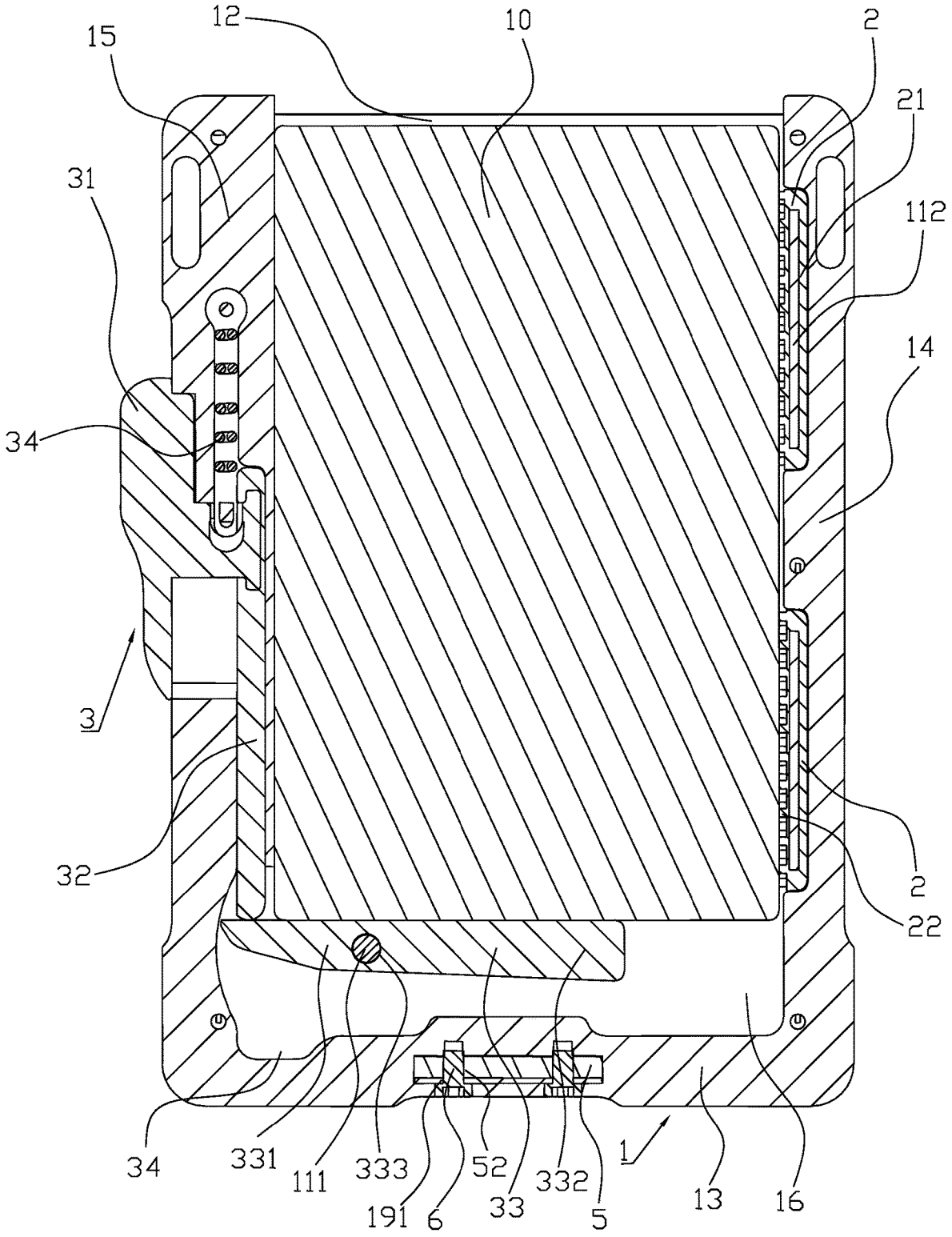
FIG. 10 is another sectional view cut along an elastic piece, a positioning piece, a rotating shaft, and a pushing device.

In the present embodiment, referring to FIG. 10, the card holder further includes a pushing device 3. The pushing device 3 is connected to the shell 1, and the pushing device 3 is used for pushing the card out of the first accommodating cavity 11 through the first accommodating opening 12. The pushing device 3 includes a pushing button 31, a pushing rod 32, and a pushing plate 33. A sliding rail 18 is arranged on the shell 1. The pushing button 31 is capable of sliding on the sliding rail 18. The pushing rod 32 is connected to the pushing button 31, so that the pushing rod 32 is capable of sliding with the pushing button 31. The pushing plate 33 has a first end 331 and a second end 332. A mounting port 333 is between the first end 331 and the second end 332. A rotating shaft 111 is arranged at a bottom of an inner wall of the first accommodating cavity 11. The rotating shaft 111 is arranged in the mounting port 333 of the pushing plate 33 in a sleeving manner. When the pushing button 31 and the pushing rod 32 push the first end 331 to a direction deviating from the first accommodating opening 12, and the second end 332 is pushed to a direction towards the first accommodating opening 12 to push the card out of the first accommodating cavity 11 towards the first accommodating opening 12. Specifically, the pushing device 3 further includes an elastic reset piece 34. One end of the elastic reset piece is connected to the first accommodating cavity 11. The other end of the elastic reset piece 34 is connected to one end of the pushing rod 32. When the other ends of the pushing button 31 and the pushing rod 32 push the first end 331 to a direction deviating from the first accommodating opening 12, the elastic reset piece 34 is stretched. An elastic reset force provided when the elastic reset piece 34 is stretched may pull the pushing rod 32 and the pushing button 31 to reset to a direction towards the accommodating opening 12. Further, a plurality of steps 7 are formed on the second end 332. The height of the plurality of steps 7 gradually increases from the second end 332 to the first end 331. Further, the number of the plurality of steps 7 is at least 2. Through the above structure, the user may slide the pushing button to drive the pushing rod to push the first end to the direction deviating from the first accommodating opening, so that the second end is pushed to the direction towards the first accommodating opening. At this moment, the elastic reset piece is stretched, and the second end applies a pushing force to the card, so as to push the card out of the first accommodating cavity towards the first accommodating opening. Moreover, the plurality of steps are formed on the second end, the height of the plurality of steps gradually increases from the second end to the first end, the plurality of steps at different heights may push the cards located at various height positions in the first accommodating cavity, and the contact positions between the steps at different heights and the cards are not on the same axis, so that the plurality of cards are pushed at different distances when various steps on the second end push a plurality of cards in the first accommodating cavity. Therefore, the plurality of cards are staggered from each other, and the user can take desired cards accurately and quickly. When the user releases the pushing button, the elastic reset force generated when the elastic reset piece is stretched may pull the pushing button and the pushing rod to reset to the direction towards the first accommodating opening.

Figure 7:
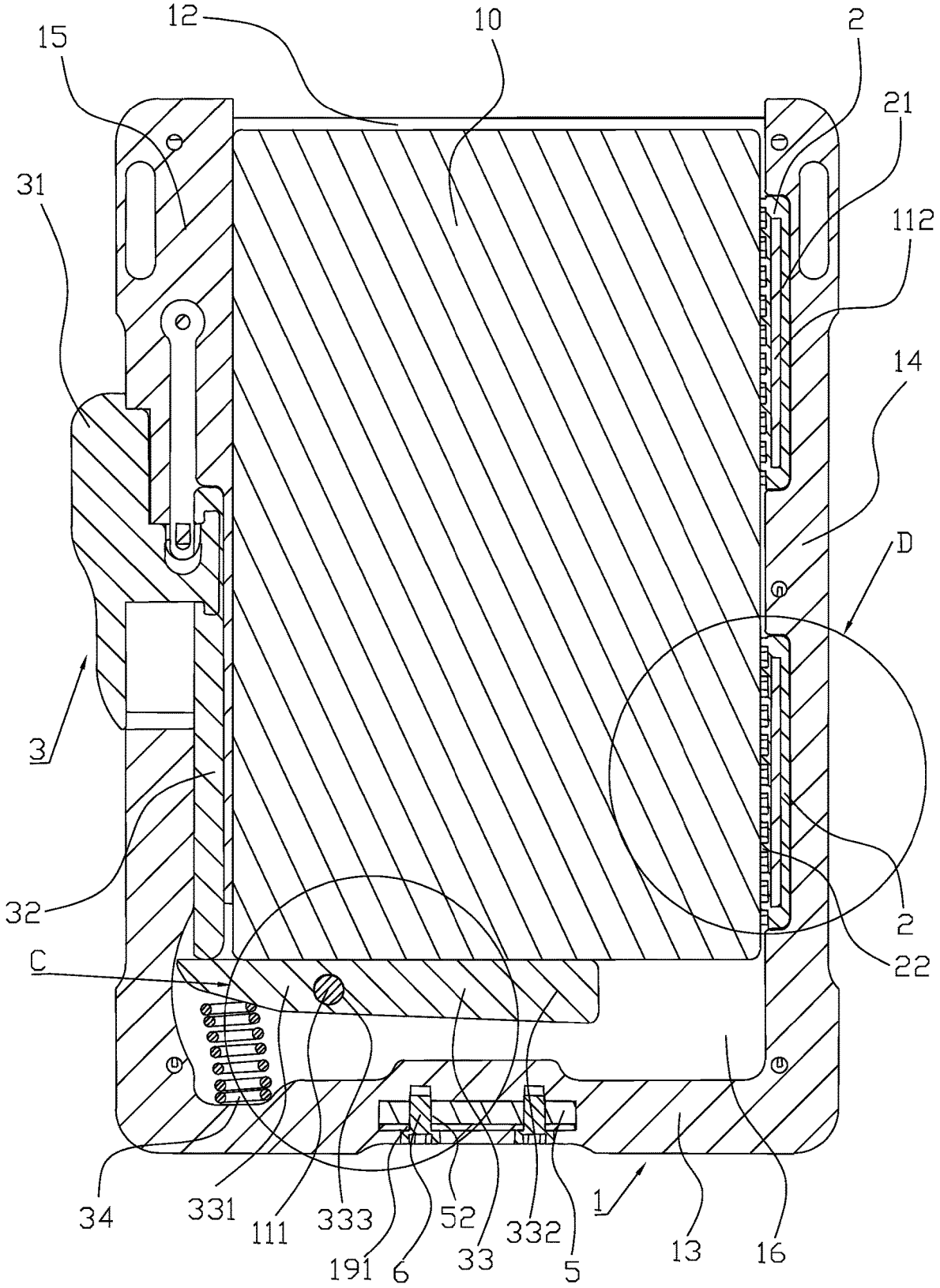
FIG. 7 is a sectional view cut along an elastic piece, a positioning piece, a rotating shaft, and a pushing device.
Figure 8:
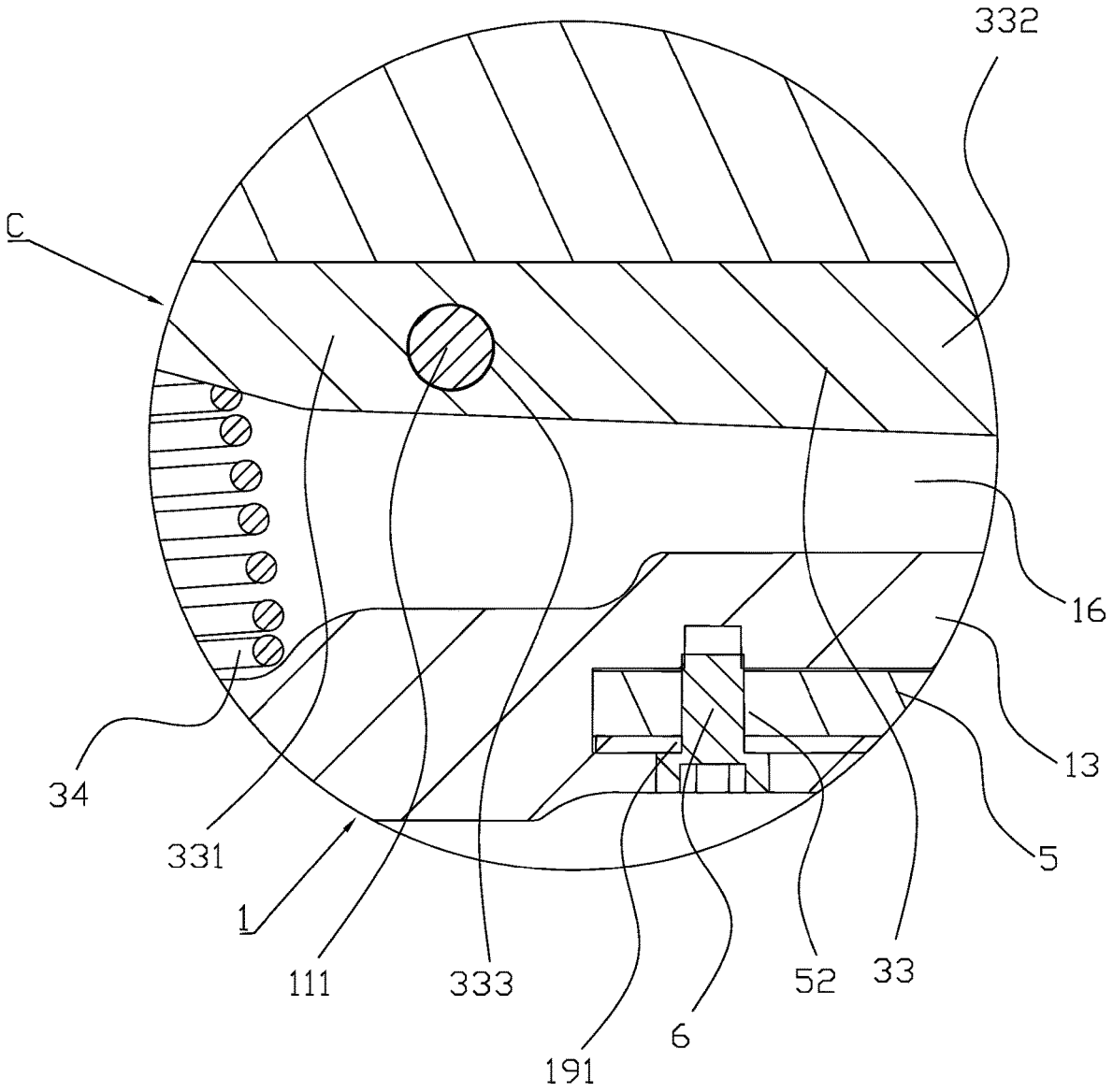
FIG. 8 is an enlarged view of C in FIG. 7.
Figure 9:
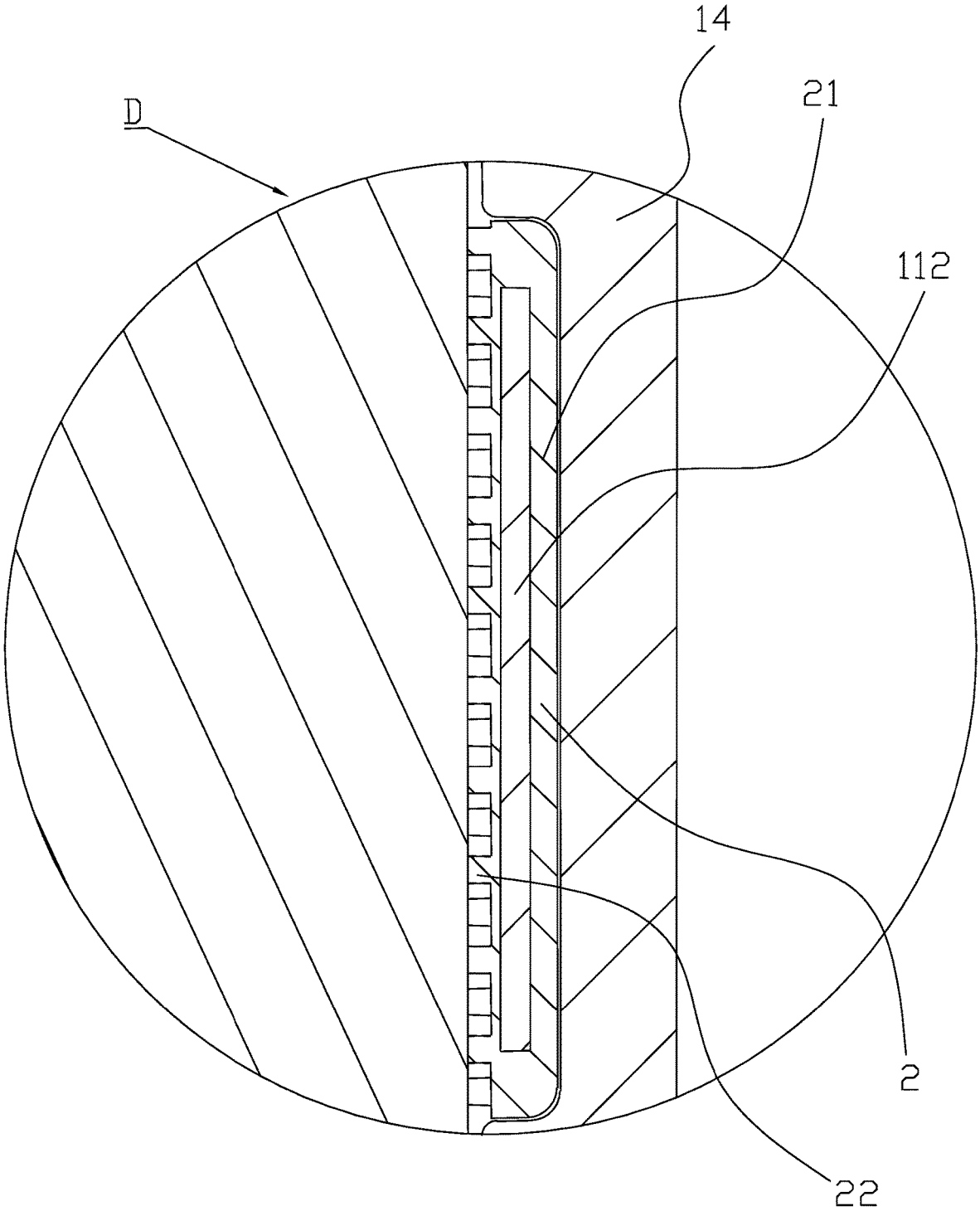
FIG. 9 is an enlarged view of D in FIG. 7.

Referring to FIG. 7, the present embodiment provides a method for mounting another elastic reset device. The pushing device 3 further includes an elastic reset piece 34. One end of the elastic reset piece 34 is connected to the first end 331. The other end of the elastic reset piece 34 is connected to a bottom of the first accommodating cavity 11. When the pushing button 31 and the pushing rod 32 push the first end 331 to the direction deviating from the first accommodating opening 12, the elastic reset piece 34 is compressed. An elastic reset force provided when the elastic reset piece 34 is compressed may push the first end 331, the pushing rod 32, and the pushing button 31 to reset to the direction towards the accommodating opening 12.

The user may slide the pushing button to drive the pushing rod to push the first end to the direction deviating from the first accommodating opening, so that the second end is pushed to the direction towards the first accommodating opening. The second end applies a pushing force greater than the elastic reset force generated when the elastic piece is compressed, so as to push the card out of the first accommodating cavity towards the first accommodating opening. Moreover, the plurality of steps are formed on the second end, the height of the plurality of steps gradually increases from the second end to the first end, the plurality of steps at different heights may push the cards located at various height positions in the first accommodating cavity, and the contact positions between the steps at different heights and the cards are not on the same axis, so that the plurality of cards are pushed at different distances when various steps on the second end push a plurality of cards in the first accommodating cavity. Therefore, the plurality of cards are staggered from each other, and the user can take desired cards accurately and quickly.

In the present disclosure, the shell 1 further includes a first side wall 13 opposite to the first accommodating opening 12, and a second side wall 14, a third side wall 15 opposite to the second side wall 14, and a fourth side wall 16, and a fifth side wall 17 opposite to the fourth side wall 16; the first accommodating cavity 11 is formed by enclosure of the first side wall 13, the second side wall 14, the third side wall 15, the fourth side wall 16, and the fifth side wall 17; and the elastic piece 2 is arranged on an inner surface of the second side wall 14; and the elastic piece 2 is used for pressing and locking the card on the third side wall 15. The slide rail is arranged on the third side wall. Specifically, the positioning piece 112 is arranged on the inner surface of the fourth side wall or the fifth side wall, and the positioning piece is arranged on the left side of the fourth side wall or the fifth side wall. Specifically, the rotating shaft 111 is arranged on the inner surface of the fourth side wall or the fifth side wall, and the rotating shaft 111 is arranged on the lower side of the fourth side wall or the fifth side wall. Further, the first side wall is a front side wall of the shell; the second side wall is a left side wall of the shell; the third side wall is a right side wall of the shell; the fourth side wall is a lower side wall of the shell; and the fifth side wall is an upper side wall of the shell. Through the structure, the elastic piece is mounted and the first accommodating cavity and the first accommodating opening are arranged effectively.

In the present embodiment, the fifth side wall 17 is detachably connected to the first side wall 13, the second side wall 14, and the third side wall 15. Through the structure, the fifth side wall may be detached from the first side wall 13, the second side wall 14, and the third side wall by the user, so as to facilitate mounting the elastic piece and the pushing device by the user.

In the present embodiment, the card holder further includes a flexible protective sleeve 4. The protective sleeve 4 has a first part 41 and a second part 42. The second part 42 and the first part 41 are capable of rotating relative to each other. The first part 41 is connected to an outer surface of the fourth side wall 16. When the second part 42 rotates to cover an outer surface of the fifth side wall 17, the second part 42 covers the first accommodating opening 12. The second part 42 is provided with a magnetic attraction piece 421. The fifth side wall 17 is a magnetic metal side wall. When the second part 42 rotates to cover the outer surface of the fifth side wall 17, the second part 42 is attracted to the outer surface of the fifth side wall 17 by the magnetic attraction piece 421. Through the structure, the user may hold the card holder more comfortably due to the flexible protective sleeve. When the second part 42 rotates to cover the outer surface of the fifth side wall 17, the second part 42 is attracted to the outer surface of the fifth side wall 17 by the magnetic attraction piece 421 to cover the first accommodating opening, so as to further prevent the card from falling out from the first accommodating cavity.

In the present embodiment, the card holder further includes an elastic clip 5. One end of the clip 5 is connected to the shell 1. The other end of the clip 5 is tightly pressed to the first part 41 to form clamping space 51 between the clip 5 and the first part 41. The shell also has a mounting groove 19. The card holder further includes a first connecting piece 6. A side wall of the mounting groove 19 has a first mounting hole 191. A second mounting hole 52 is formed in one end of the clip 5. When one end of the clip is inserted into the mounting groove 19, the first mounting hole 191 is aligned with the second mounting hole 52. The first connecting piece 6 penetrates through the first mounting hole 191 and the second mounting hole 52 in sequence, so as to fix one end of the clip 5 to the interior of the mounting groove 19. Through the structure, the structure is simple, the connection is stable, the clip is effectively mounted, and cards or changes may be placed in the clamping space by toggling the clip. Moreover, the clip may also be clamped on a leather belt or a pocket through the clamping space.

In the present embodiment, the first part 41 includes a first plate body 411 and a second plate body 412. The inner side of the first plate body 411 covers the outer surface of the fourth side wall 16. The second plate body 412 is connected to an outer side of the first plate body 411, and a second accommodating cavity 413 is formed between an inner side of the second plate body 412 and an outer wall of the first plate body 411. An upper side of the second accommodating cavity 413 has a second accommodating opening 414, and a first gap 415 is formed in a lower side of the second accommodating cavity 413. Through the structure, the protective sleeve is mounted effectively, and cards may also be placed in the second accommodating cavity, so that the card holder can accommodate more cards. Moreover, the cards may be pushed out of the second accommodating cavity via the second accommodating opening through the first gap formed in the lower side of the second accommodating cavity, so as to facilitate taking the cards by the user.

One end of the clip 5 is connected to the shell 1, and the other end of the clip 5 is tightly pressed to the first plate body 411, so that clamping space 51 is formed between the clip 5 and the first part 41. Through the structure, the other end of the clip 5 is tightly pressed to the second plate body, so that the second plate body may tightly press the cards in the second accommodating cavity, which prevents the cards from sliding out of the second accommodating cavity via the second accommodating opening.

In the present embodiment, the second part 42 includes a third plate body 422, a fourth plate body 423, a fifth plate body 424, and a sixth plate body 425. The third plate body 422 is rotatably connected to the first plate body 411. The fourth plate body 423 is connected to the inner side of the third plate body 422. A third accommodating cavity 43 is formed between the fourth plate body 411 and the inner side of the third plate body 422. The upper side of the third accommodating cavity 43 has a third accommodating opening 431. The lower side of the third accommodating cavity 43 has a second gap 432. The fifth plate body 424 is connected to the outer side of the third plate body 422. A fourth accommodating cavity 44 is formed between the inner side of the fifth plate body 424 and the outer side of the third plate body 422. The upper side of the fourth accommodating cavity 44 has a fourth accommodating opening 441. The sixth plate body 425 is connected to the outer side of the third plate body. A fifth accommodating cavity 45 is formed between the inner side of the sixth plate body 425 and the outer side of the fifth plate body 424. An upper side of the fifth accommodating cavity 45 has a fifth accommodating opening 451. A lower side of the fifth accommodating cavity 45 has a third gap 452. The third gap 452, the fifth accommodating cavity 45, and the fourth accommodating cavity 44 are communicated with one another. Through the structure, the protective sleeve is mounted effectively, and cards may also be placed in the third accommodating cavity, the fourth accommodating cavity, and the fifth accommodating cavity, so that the card holder can accommodate more cards. Moreover, the cards can be pushed out of the third accommodating cavity via the third accommodating opening through the second gap, so as to facilitate taking the cards by the user. The cards can be pushed out of the fourth accommodating cavity via the fourth accommodating opening through the third gap, and pushed out of the fifth accommodating cavity through the fifth accommodating opening.

In the present embodiment, the protective sleeve further includes a seventh plate body 426 and an eighth plate body 427. The inner side of the seventh plate body 426 is connected to the fourth side wall 16. The eighth plate body 427 is connected to an outer side of the seventh plate body 426, and a sixth accommodating cavity 46 is formed between the inner side of the eighth plate body 427 and the outer side of the seventh plate body 426. A sixth accommodating opening 461 is formed in an upper side of the sixth accommodating cavity 46. A transparent area 428 is formed in the eighth plate body 427. A fourth gap 429 is formed in the transparent area 428. The fourth gap 429 is communicated with the sixth accommodating cavity 461. Through the structure, the protective sleeve is mounted effectively, and cards can also be placed in the sixth accommodating cavity, so that the card holder can accommodate more cards. Moreover, the cards can be pushed out of the sixth accommodating cavity via the sixth accommodating opening through the fourth gap, so as to facilitate taking the cards by the user. Moreover, types of the cards placed in the sixth accommodating cavity can also be observed through the transparent area.

In the present disclosure, a hanging port 6 is also formed in the shell 1. Through the structure, a hanging rope can be mounted through the hanging port.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A card holder, comprising:

a shell, the shell having a first accommodating cavity and a first accommodating opening, the first accommodating opening being communicated with the first accommodating cavity, and the first accommodating cavity being used for accommodating a card; and an elastic piece, the elastic piece being arranged in the first accommodating cavity, and the elastic piece being used for pressing and locking the card in the first accommodating cavity;

wherein the card holder further comprises a pushing device, the pushing device is connected to the shell, and the pushing device is used for pushing the card out of the first accommodating cavity via the first accommodating opening;

wherein the pushing device comprises a pushing button, a pushing rod, and a pushing plate; a sliding rail is arranged on the shell; the pushing button is capable of sliding on the sliding rail; the pushing rod is connected to the pushing button, so that the pushing rod is capable of sliding with the pushing button; the pushing plate has a first end and a second end; a mounting port is between the first end and the second end; a rotating shaft is arranged at a bottom of an inner wall of the first accommodating cavity; the rotating shaft is arranged in the mounting port of the pushing plate in a sleeving manner; and when the pushing button and the pushing rod push the first end to a direction deviating from the first accommodating opening, the second end is pushed to a direction towards the first accommodating opening to push the card out of the first accommodating cavity towards the first accommodating opening;

wherein the pushing device further comprises an elastic reset piece; one end of the elastic reset piece is connected to the first accommodating cavity; the other end of the elastic reset piece is connected to one end of the pushing rod; when the other ends of the pushing button and the pushing rod push the first end to a direction deviating from the first accommodating opening, the elastic reset piece is stretched; and an elastic reset force provided when the elastic reset piece is stretched is capable of pulling the pushing rod and the pushing button to reset to a direction towards the accommodating opening.

2. The card holder according to claim 1, wherein the elastic piece is a silicone elastic piece.

3. The card holder according to claim 2, wherein a positioning piece is also arranged on the inner wall of the first accommodating cavity; a positioning opening is formed in the elastic piece; and the positioning piece is arranged in the positioning opening in a sleeving manner.

4. The card holder according to claim 1, wherein the shell further comprises a first side wall opposite to the first accommodating opening, and a second side wall, a third side wall opposite to the second side wall, and a fourth side wall, and a fifth side wall opposite to the fourth side wall; the first accommodating cavity is formed by enclosure of the first side wall, the second side wall, the third side wall, the fourth side wall, and the fifth side wall; the elastic piece is arranged on an inner surface of the second side wall; and the elastic piece is used for pressing and locking the card on the third side wall.

5. The card holder according to claim 1, wherein a plurality of elastic bulges are formed on the elastic piece; and the card is pressed and locked in the first accommodating cavity by the elastic bulges.

6. A card holder, comprising:

a shell, the shell having a first accommodating cavity and a first accommodating opening, the first accommodating opening being communicated with the first accommodating cavity, and the first accommodating cavity being used for accommodating a card; and an elastic piece, the elastic piece being arranged in the first accommodating cavity, and the elastic piece being used for pressing and locking the card in the first accommodating cavity;

wherein the card holder further comprises a pushing device, the pushing device is connected to the shell, and the pushing device is used for pushing the card out of the first accommodating cavity via the first accommodating opening;

wherein the pushing device comprises a pushing button, a pushing rod, and a pushing plate; a sliding rail is arranged on the shell; the pushing button is capable of sliding on the sliding rail; the pushing rod is connected to the pushing button, so that the pushing rod is capable of sliding with the pushing button; the pushing plate has a first end and a second end; a mounting port is between the first end and the second end; a rotating shaft is arranged at a bottom of an inner wall of the first accommodating cavity; the rotating shaft is arranged in the mounting port of the pushing plate in a sleeving manner; and when the pushing button and the pushing rod push the first end to a direction deviating from the first accommodating opening, the second end is pushed to a direction towards the first accommodating opening to push the card out of the first accommodating cavity towards the first accommodating opening;

wherein the pushing device further comprises an elastic reset piece; one end of the elastic reset piece is connected to the first end; the other end of the elastic reset piece is connected to a bottom of the first accommodating cavity; when the pushing button and the pushing rod push the first end to a direction deviating from the first accommodating opening, the elastic reset piece is compressed; an elastic reset force provided when the elastic reset piece is compressed is capable of pushing the first end, the pushing rod, and the pushing button to reset towards the accommodating opening.

7. The card holder according to claim 6, wherein the elastic piece is a silicone elastic piece.

* * * * *